US007350670B2

(12) United States Patent
Steeves et al.

(10) Patent No.: US 7,350,670 B2
(45) Date of Patent: Apr. 1, 2008

(54) BAG-IN-BOX CONTAINER

(75) Inventors: Scott Marc Steeves, San Diego, CA (US); Craig William Buscema, Lithia Springs, GA (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 331 days.

(21) Appl. No.: 10/955,684

(22) Filed: Sep. 30, 2004

(65) Prior Publication Data

US 2006/0071021 A1 Apr. 6, 2006

(51) Int. Cl.
*B65D 35/56* (2006.01)

(52) U.S. Cl. ..... 222/105; 229/117.3

(58) Field of Classification Search ..... 222/105, 222/106, 110, 93; 414/801; 229/918, 143, 229/191, 117.3–117.35, 108–114
See application file for complete search history.

(56) References Cited

U.S. PATENT DOCUMENTS 3,233,817 A * 2/1966 Casady ..... 229/117.3
4,572,422 A * 2/1986 Heuberger et al. ..... 229/117.3
4,702,408 A * 10/1987 Powlenko ..... 229/101
5,147,271 A * 9/1992 Bacques et al. ..... 493/176
5,160,307 A 11/1992 Bacques et al.
5,295,623 A 3/1994 Bacques et al.
5,351,849 A * 10/1994 Jagenburg et al. ..... 229/117.3
5,381,948 A 1/1995 Coalier et al.
5,395,043 A 3/1995 Bacques et al.
5,400,955 A 3/1995 Coalier et al.
5,497,899 A 3/1996 Wuerfel
5,713,469 A 2/1998 Buscema
5,749,489 A * 5/1998 Benner et al. ..... 229/117.3
5,755,377 A * 5/1998 Durand ..... 229/110
6,216,871 B1 4/2001 Bacques et al.
6,257,411 B1 7/2001 Bacques et al.
6,264,034 B1 7/2001 Bacques et al.
6,371,363 B1 * 4/2002 Franklin et al. ..... 229/109
6,394,742 B1 5/2002 Buscema
6,786,394 B2 * 9/2004 Prince ..... 229/117.3
7,090,115 B2 * 8/2006 Pierce ..... 229/109

* cited by examiner

*Primary Examiner*—Lien M. Ngo
(74) *Attorney, Agent, or Firm*—Armstrong Teasdale LLP

(57) ABSTRACT

A bag-in-box beverage container and dispenser is provided, incorporating an outer box fabricated preferably from corrugated paperboard material, and an inner liquid containing bag, fabricated from a suitable material. The outer box has two pairs of opposing side panels, and at least one diagonal corner panel. One of the side panels has an openable structure for permitting access to the interior of the box, to enable a consumer to grasp and withdraw the dispensing fixture of the inner liquid containing bag, and capture it within the openable structure. In embodiments having more than one diagonal corner panel, at least one of the diagonal corner panels is larger than at least one of the other diagonal corner panels, to permit the container to be tipped onto that elongated diagonal corner panel, for facilitated dispensing of the liquid contained in the inner bag.

19 Claims, 3 Drawing Sheets

BAG-IN-BOX CONTAINER

BACKGROUND OF THE INVENTION

1. Field of the Invention

The present invention relates to bag-in-box style cartons and containers, of the type in which a non-self-supporting plastic bag or the like is positioned in a surrounding, supporting container structure, the entire package being disposable after a single use. The present invention also relates to large volume urn-style beverage containers.

2. The Prior Art

Urn-style beverage containers, for the containment and controlled incremental dispensing of a relatively large volume (2+ gallons) of liquid are known. Typically, such urn-style beverage containers are reusable devices of metal and plastic, which can be heavy, and which; of course, require cleaning after each use. Various versions of such devices are known as "pump pots"; "air pots"; various all-plastic urns (sold under the registered trademark "Cam-Servers") and buckets with spigots, both manufactured by Cambro Manufacturing Company of Huntington Beach, Calif. There are also known in the art octagonal and rectangular cross-section bag-in-corrugated paperboard box configurations, such as those sold by BIB Pak, Inc., of Racine, Wis. The rectangular bag-in-box construction is also shown in Geshay, U.S. Pat. No. 6,062,431, owned by BIB Pak, Inc., of Racine, Wis.

Retail and wholesale (catering) food service operators typically have need of such large volume beverage containers. However, permanent, reusable urns may be subject to various disadvantages and/or impose certain costs of operation, upon retail customers and/or retail and wholesale food service operators. For example, caterers must address the need to physically retrieve the urns, requiring expenditures of labor and fuel. The urns must be cleaned and stored, again requiring expenditures of labor, cleaning supplies, and storage space. Reusable urns are often the subject of theft or "mysterious" disappearance, imposing unscheduled replacement costs, as well as the replacement costs associated with the cycling out of units as a result of normal wear and tear. If units are lost/stolen or in disrepair, the business operator runs the risk of lost sales.

Bag-in-box containers are known, which typically involve a flexible, liquid-impermeable bag, having a spigot, or cap and spout fitting, that is received within a rectangular parallelepiped container, usually fabricated from paper, paperboard and/or corrugated paperboard.

However, rectangular parallelepiped-shaped surrounding containers can be somewhat awkward to handle, during filling and emptying.

Also known in the prior art are jug-in-box containers, wherein a relatively rigid plastic jug is held within a rectangular parallelepiped box, usually of corrugated paperboard. Such containers are manufactured by Ring Can Corporation, as exemplified by Wuerfel, U.S. Pat. No. 5,497,899.

Accordingly, it would be desirable to provide a large volume beverage dispenser which addresses the foregoing issues.

It would be desirable to provide a large volume dispenser which is disposable, and preferably fabricated in large part from recyclable materials, and which is configured for easy knock-down for recycling and disposal.

It would also be desirable to provide a large volume dispenser which provides areas for placement of advertising copy, images or indicia, which promote brand identity, products and services, and/or "fitness for use" safety precaution instructions.

It would also be desirable to provide a bag-in-box container that has improved filling of the available space within the surrounding container.

It would also be desirable to provide a bag-in-box container which is easier to physically handle, and which can be more completely emptied than bag-in-box containers having rectangular parallelepiped outer containers.

These and other desirable characteristics of the present invention will become apparent in view of the present specification and drawings.

SUMMARY OF THE INVENTION

The present invention comprises, in part, a bag-in-box container, for dispensing liquids. The bag-in-box container comprises an outer box and an inner liquid-impermeable bag, having a dispensing fixture. The outer box has a front face; and a rear face, disposed substantially parallel to the front face. Two pairs of opposing side panels extend between the front face and the rear face, a first of the two pairs of opposing side panels being disposed substantially perpendicular to a second of the two pairs of opposing side panels. At least one of the side panels has structure disposed therein for receiving and retaining the dispensing fixture of the liquid-impermeable bag. A plurality of diagonal corner panels extend between the front and rear faces, and between adjacent ones of the side panels. Each of the side panels has a length which is substantially greater than the lengths of the diagonal corner panels. At least one of the diagonal corner panels, disposed adjacent to the side panel having the dispensing fixture receiving and retaining structure, has an elongated length, which is substantially greater than at least one other of the diagonal corner panels, for enabling the bag-in-box container to be tipped onto one of the at least one elongated diagonal corner panels, for facilitated dispensing of liquid contained within the inner liquid impermeable bag.

The plurality of diagonal corner panels may comprise four diagonal corner panels, with each diagonal corner panel disposed between and connecting two side panels. Three of the diagonal corner panels may have a first length, and a fourth of the diagonal corner panels preferably has a second length which is substantially greater than the first lengths of the other three diagonal corner panels.

The bag-in-box container may have an octagonal cross-sectional configuration. The dispensing fixture receiving and retaining structure may comprise a dispensing fixture retaining flap, pivotably disposed in the side panel; and a disc, formed by a circumferential frangible line of weakness, disposed adjacent to the dispensing fixture retaining flap. Upon removal of the disc, and pivoting of the dispensing fixture retaining flap, access to the interior of the outer box is provided, for enabling withdrawal of the dispensing fixture of the inner liquid impermeable bag.

The present invention also comprises, in part, a box, operably configured for containing therein a liquid-impermeable bag of the type having a dispensing fixture, for facilitating dispensing of a liquid from a liquid impermeable bag when contained within the box. The box comprises a front face; and a rear face, disposed substantially parallel to the front face. Two pairs of opposing side panels extend between the front face and the rear face, a first of the two pairs of opposing side panels being disposed substantially perpendicular to a second of the two pairs of opposing side panels. At least one of the side panels has structure disposed therein for receiving and retaining a dispensing fixture of a liquid-impermeable bag. A plurality of diagonal corner panels extend between the front and rear faces, and between adjacent ones of the side panels. Each of the side panels preferably has a length which is substantially greater than the lengths of the diagonal corner panels. At least one of the diagonal corner panels, disposed adjacent to the side panel having the dispensing fixture receiving and retaining structure, has an elongated length which is substantially greater than at least one other of the diagonal corner panels, for enabling the box to be tipped onto one of the at least one elongated diagonal corner panels, for facilitated dispensing of liquid contained within a liquid impermeable bag, when disposed in the box.

In this embodiment, the plurality of diagonal corner panels may comprise four diagonal corner panels, with each diagonal corner panel disposed between and connecting two side panels. Three of the diagonal corner panels preferably have a first length, and a fourth of the diagonal corner panels has a second length which is substantially greater than the first lengths of the other three diagonal corner panels. The box may have an octagonal cross-sectional configuration. The dispensing fixture receiving and retaining structure may comprise a dispensing fixture retaining flap, pivotably disposed in the side panel; and a disc, formed by a circumferential frangible line of weakness, disposed adjacent to the dispensing fixture retaining flap. Upon removal of the disc, and pivoting of the dispensing fixture retaining flap, access to the interior of the box is provided, for enabling withdrawal of a dispensing fixture of a liquid impermeable bag, when disposed in the box.

The present invention also comprises, in part, a blank for forming box, operably configured for containing therein a liquid-impermeable bag of the type having a dispensing fixture, for facilitating dispensing of a liquid from a liquid impermeable bag when contained within the box. The blank comprises a plurality of substantially rectangular side panels; and a plurality of substantially rectangular diagonal corner panels, disposed between adjacent ones of the substantially rectangular side panels. The side panels and the diagonal corner panels together form a sequence of container panels. The sequence has a longitudinal axis, and begins and terminates with side panels, the beginning and terminating side panels having opposing free edges. A manufacturer's joint panel emanates from the respective free edges of the beginning and terminating side panels. Face panels emanate from opposing edges of alternating ones of the side panels, in directions substantially perpendicular to the longitudinal axis of the sequence of container panels. Each of the side panels preferably has a length which is substantially greater than the lengths of the diagonal corner panels. At least one of the side panels has structure disposed therein for receiving and retaining a dispensing fixture of a liquid-impermeable bag. The manufacturer's joint panels are configured, upon articulation of the blank, to be disposed in overlying, partially overlapping configuration, to form a composite diagonal corner panel having a length which is substantially greater than that of at least one of the other diagonal corner panels, for enabling the box to be tipped onto one of the at least one elongated diagonal corner panels, for facilitated dispensing of liquid contained within a liquid impermeable bag, when disposed in the box. The blank preferably further comprises support panels emanating from opposing edges of remaining ones of the side panels, in directions substantially perpendicular to the longitudinal axis. The blank may also further comprise a hand-hold formed in one of the face panels. The plurality of side panels preferably comprises four side panels, and the plurality of diagonal corner panels preferably comprises three diagonal corner panels.

The invention also comprises in part a bag-in-box container, for dispensing liquids, comprising an outer box; and an inner liquid-impermeable bag, having a dispensing fixture. The outer box has a front face; and a rear face, disposed substantially parallel to the front face. Two pairs of opposing side panels extend between the front face and the rear face, a first of the two pairs of opposing side panels being disposed substantially perpendicular to a second of the two pairs of opposing side panels. A plurality of diagonal corner panels extends between the front and rear faces, and between adjacent ones of the side panels. Each of the side panels preferably has a length which is substantially greater than the lengths of the diagonal corner panels. At least one of the diagonal corner panels has structure disposed therein for receiving and retaining the dispensing fixture of the liquid-impermeable bag for enabling the bag-in-box container to be tipped onto one of the side panels, for facilitated dispensing of liquid contained within the inner liquid impermeable bag, from the diagonal corner panel.

In this embodiment, the diagonal corner panel having the structure disposed therein for receiving and retaining the dispensing fixture of the liquid-impermeable bag, has a length greater than at least one other of the diagonal corner panels.

The invention also comprises, in part, an alternative embodiment of the invention of a bag-in-box container, for dispensing liquids, comprising, in turn, an outer box; and an inner liquid-impermeable bag, having a dispensing fixture. The outer box has a front face; and a rear face, disposed substantially parallel to the front face. Two pairs of opposing side panels extend between the front face and the rear face, a first of the two pairs of opposing side panels being disposed substantially perpendicular to a second of the two pairs of opposing side panels. At least one of the side panels has structure disposed therein for receiving and retaining the dispensing fixture of the liquid-impermeable bag. At least one diagonal corner panel extends between the front and rear faces, and between adjacent ones of the side panels. Each of the side panels has a length which is substantially greater than the length of the at least one diagonal corner panel. The bag-in-box container is configured to be tipped onto the at least one diagonal corner panel, for facilitated dispensing of liquid contained within the inner liquid impermeable bag.

The invention also comprises, in part, a blank for forming box, operably configured for containing therein a liquid-impermeable bag of the type having a dispensing fixture, for facilitating dispensing of a liquid from a liquid impermeable bag when contained within the box, in which the blank comprises a plurality of substantially rectangular side panels; and at least one substantially rectangular diagonal corner panel, disposed between adjacent ones of the substantially rectangular side panels. The side panels and the at least one diagonal corner panel together form a sequence of container panels, the sequence having a longitudinal axis and beginning and terminating with side panels, the beginning and terminating side panels having opposing free edges. A manufacturer's joint panel emanates from the respective free edges of the beginning and terminating side panels. Face panels emanate from opposing edges of alternating ones of the side panels, in directions substantially perpendicular to the longitudinal axis of the sequence of container panels. Each of the side panels has a length which is substantially greater than the length of the at least one diagonal corner panel. At least one of the side panels has structure disposed therein for receiving and retaining a dispensing fixture of a liquid-impermeable bag. The blank is operably configured, upon articulation, to form a box, capable of being tipped onto the at least one diagonal corner panel, for facilitated dispensing of liquid contained within a liquid impermeable bag, when disposed in the box.

The present invention also comprises, in part, a box, operably configured for containing therein a liquid-impermeable bag of the type having a dispensing fixture, for facilitating dispensing of a liquid from a liquid impermeable bag when contained within the box. The box, in turn, comprises a front face; and a rear face, disposed substantially parallel to the front face. Two pairs of opposing side panels extend between the front face and the rear face, a first of the two pairs of opposing side panels being disposed substantially perpendicular to a second of the two pairs of opposing side panels. At least one of the side panels has structure disposed therein for receiving and retaining a dispensing fixture of a liquid-impermeable bag. At least one diagonal corner panel extends between the front and rear faces, and between adjacent ones of the side panels. Each of the side panels has a length which is substantially greater than the length of the at least one diagonal corner panel. The box is operably configured to be tipped onto one of the at least one elongated diagonal corner panels, for facilitated dispensing of liquid contained within a liquid impermeable bag, when disposed in the box.

DETAILED DESCRIPTION OF THE DRAWINGS

Figure 1:
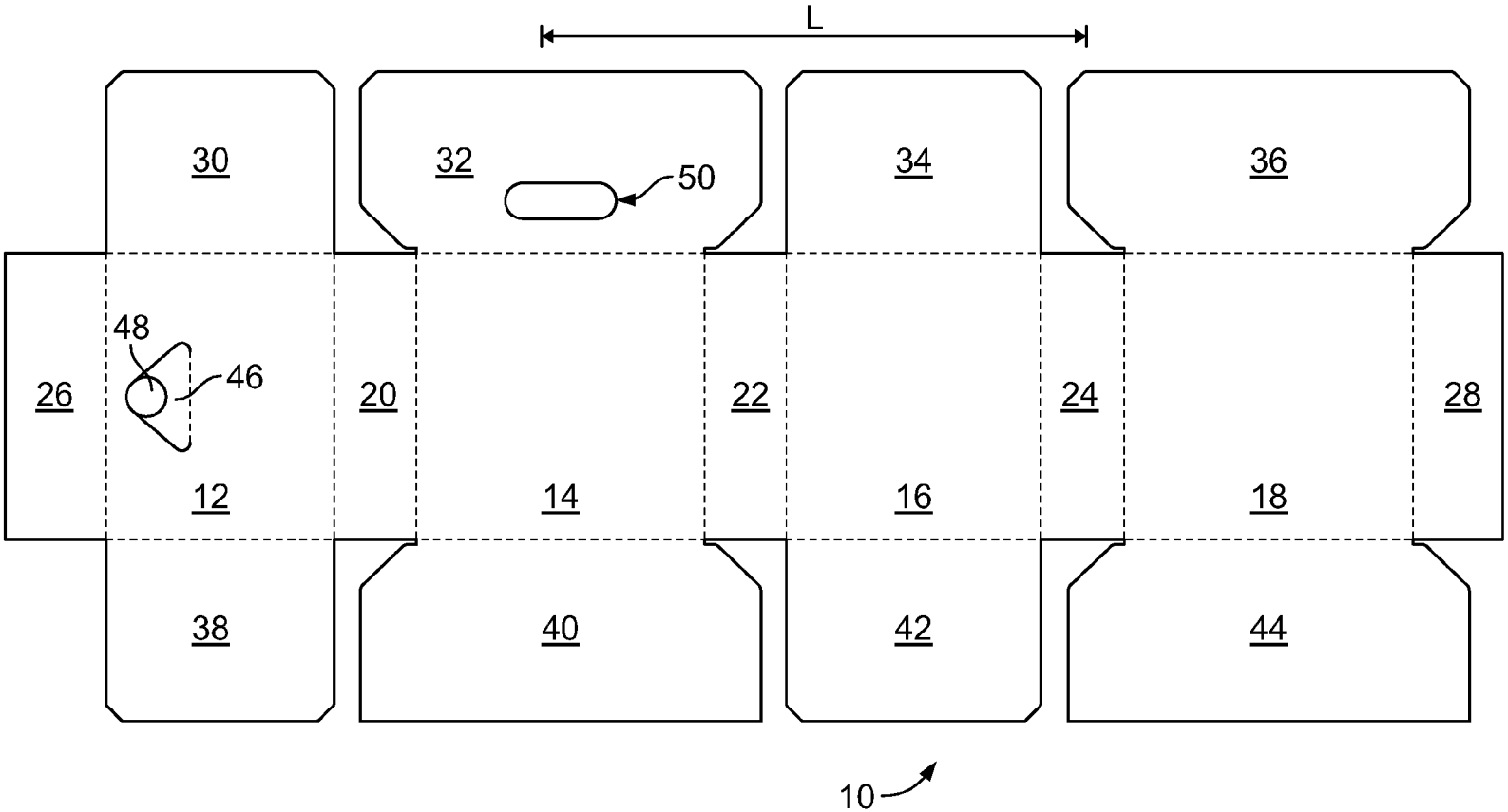
FIG. 1 is a plan view of a blank for a bag-in-box container according to a preferred embodiment of the invention.

While this invention is susceptible of embodiment in many different forms, there are shown in the drawings and will be described in detail, several specific embodiments, with the understanding that the present disclosure is to be considered as an exemplification of the principles of the invention and is not intended to limit the invention to the embodiments illustrated.

Figure 2:
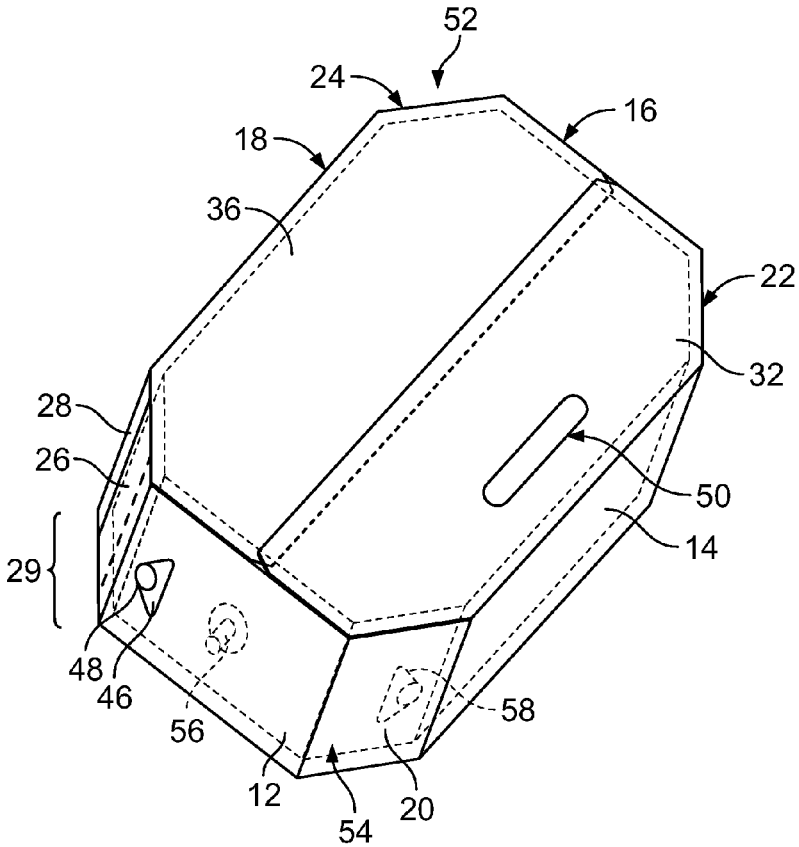
FIG. 2 is a perspective view of an assembled bag-in-box container according to the embodiment of FIG. 1, in which the contained bag is shown in broken lines.

In some preferred embodiments of the invention, each of the blanks illustrated herein, in FIGS. 1-2, are fabricated from corrugated paperboard material, although similar paper-based materials, having similar performance characteristics, may be employed if desired.

In accordance with the usual conventions regarding the illustration of blanks of foldable material, unless otherwise expressly indicated, solid lines within the interior of a blank represent through-cuts or apertures, and broken or dotted lines represent lines of weakness, such as score lines, perforations, or the like.

To the extent that any specific numerical values for physical dimensions are provided herein, they are given by way of example, and the invention is not intended to be limited thereto.

FIG. 1 illustrates a plan view of a blank for forming an outer box for a bag-in-box container according to a preferred embodiment of the invention. Blank 10 includes width side panel 12, length side panel 14, width side panel 16 and length side panel 18; "standard" corner panels 20, 22, and 24; manufacturer's joint panels 26 and 28; and flaps 30, 32, 34, 36, 38, 40 and 42. Side panel 12 includes dispensing fixture retaining flap 46, which is perforated along its sides leading to perforated disc 48, both of which are provided to permit the fitting (spout, spigot, etc.) of the bag to be contained in the outer box to be pulled out (from the inside), and held in place, typically by flap 44 being fitted down behind a radially outwardly projecting flange to be located on the fitting. Flap 32 includes a die-cut hand-hold aperture 50. The length direction of blank 10 is indicated by longitudinal axis L; if blank 10 is fabricated from corrugated paperboard material, the flutes will run in a direction perpendicular to longitudinal axis L.

Each of the width and length side panels has a length in the direction of axis L which is preferably substantially greater than the lengths of the corner panels. A key feature of the present invention is the fact that while each of corner panels 20, 22, 24 may have the same length in the direction of axis L, e.g., 2.5 inches (for example only), manufacturer's joint panels will have a significantly larger length. For example, panels 26, and 28 may each be three inches in length, in the direction of axis L, and upon overlapping of one another to form the manufacturer's joint, will be overlapped a distance of two and one-half inches, to provide a total combined length for the combined "long" diagonal corner panel 29 (see FIG. 2) of, for example, three and one-half inches. In order to accommodate this inequality of the lengths of the corner panels, the side panels likewise will have unequal lengths, for example, panel 12 may have a length of 7 inches; panel 14, 8 3/16 inches; panel 16, 7 11/16 inches; and panel 18, 8 3/38, inches. This combination of dimensions permits panel 12 to be parallel to panel 16, and panel 14 to be parallel to panel 18, upon articulation and gluing of blank 10. The provision of irregularly dimensioned side and corner panels has additional resultant functions, which will be discussed hereinbelow.

The extra length diagonal corner panel does not necessarily have to be the composite diagonal corner panel formed from the two manufacturer's joint panels. For example, one of panels 20, 22 or 24 could be provided with a length that is greater than the combined length of panels 26, 28 when overlapped. In order for the resultant fully articulated and glued container, with filled inner bag, to be essentially or completely balanced, when on its "long" diagonal corner panel, it is believed necessary that the "long" diagonal corner panel be at least 20% longer than the other diagonal corner panels, and that the "long" diagonal corner panel should be shorter than the shortest of the width and length side panels.

As a general matter, it is desirable that the width panels be shorter than the length panels, because this has been found to be more efficient with respect to stacking and loading of filled bag-in-box containers onto standardized shipping pallets. A container which has widths and lengths which are the same, tend not to optimize the available footprint on standardized shipping pallets. The overall length and width of the container may be readily determined by one of ordinary skill in the art, based upon the details of the particular application, including product type, product volume, bag and dispensing fixture style and palletizing requirements. Once the overall dimensions have been determined, and the lengths of the "standard" diagonal corner panels have been determined, the increased length of the "long" diagonal corner panel, and thus the lengths of the "shortened" width and length side panels, are readily determined. Typically, but not always, each of the diagonal corner panels, including the "long" diagonal corner panel, will be at a 45 degree angle, relative to the adjacent width and length panels.

Formation of the outer box is accomplished by folding the blank successively (typically about a suitably sized and shaped mandrel) along the fold lines which separate the side panels, corner panels and manufacturer's joint panels, until manufacturer's joint panels 26 and 28 are proximate one another and placed in overlapping orientation. Adhesive is applied at the interface of panels 26 and 28, and they are adhered to one another, preferably so that the resultant combined corner panel has a length which is greater than any other of the corner panels.

Next, the flaps are folded inwardly to form the front and rear faces of the resulting package. Each of flaps 30, 32, 34, 36, 38, 40 and 42 has a height (perpendicular to the direction of axis L) that is greater than one-half the height of side panels 12, 14, 16, 18. First, flaps 30, 34, for example, may be folded inwardly toward one another, until they are substantially perpendicular to side panel 12. Flaps 30, 34 will overlap one another and will be adhered to one another. Flaps 32, 36 may then be folded inwardly toward one another, so that they will overlap one another. Adhesive will be applied to one or the other of the flaps, or both, so that they will adhere, closing the face of the box.

Prior to the folding and gluing (or gluing and folding) of the flaps on the opposite side of the blank, a filled liquid bag 54 (see FIG. 2) is placed inside the partially formed box, with the fitting of the bag being preferably positioned proximate to dispensing fixture retaining flap 46 and perforated disc 48. Flaps 38, 42 are then folded in and affixed to one another, followed by flaps 40, 44.

A completely formed outer box 52 is shown in FIG. 2. Bag 54, to be contained within box 52 is shown in broken lines, and may be a liquid-impermeable bag, of any desired material and configuration, having a fitting 56 that may be a push-pull spigot, a screw-cap covered spout, or any other fitting such as are known in the art.

When in the hands of the consumer, to dispense liquid from the container, the consumer pushes in, or pries out perforated disc 48, pulls out and flips down dispensing fixture retaining flap 46, to reach in and remove the spigot, spout, etc. of the bag, contained within box 52. After the spigot, spout, etc., has been pulled out, dispensing fixture retaining flap 46 is slipped behind the flange which will be provided on the spout, to prevent the spout from being withdrawn back into the interior of box 52. Using hand hold 50, the consumer tilts the package forward, to dispense the liquid. If necessary, the package can be permitted to lie flat on composite corner panel 29, which due to its extended length, compared to the other corner panels, is sufficiently long to permit the container to rest at the inclined angle, if necessary, with a stabilizing grip on the hand hold 29.

In a preferred embodiment of the invention, the carton has four diagonal corner panels, three of which are at 45 degrees relative to their adjacent side panels.

While the embodiment of FIGS. 1 and 2 shows an outer box having three diagonal corner panels of the same length and angle relative to their adjacent side panels, it is to be understood that more than one of the diagonal corner panels may have increased length to provide yet another resting surface, for facilitating dispensing of liquid from the bag.

The container of the present invention is believed to possess several advantages over prior art bag-in-box constructions. The container construction provides a "resting surface" to allow for easier pouring. In addition, it provides for more complete evacuation of the product from the internal bag. The unique irregular octagonal cross-sectional configuration of the outer box provides a unique case shape and design, for enhanced marketing interest. Furthermore, the octagonal cross-sectional configuration provides for a reduction in the amount of material required, relative to the usable volume created, as compared to conventional rectangular parallelepiped outer box configurations. As yet another advantage, the octagonal cross-sectional configuration provides for enhanced stacking strength, when the boxes are stacked on the front and rear facing sides (the large sides perpendicular to the diagonal corners).

In an alternative preferred embodiment of the invention, the dispensing fixture receiving and retaining structure may be disposed in one of the diagonal corner panels (shown in broken lines as item 58 in FIG. 2), so that the box may be placed on one of its width side panels, and still enable facilitated dispensing and improved evacuation of the inner bag. In such an alternative embodiment, the elongated diagonal corner panel does not necessarily need to be the composite diagonal corner panel, but instead may be one of the other diagonal corner panels. In such an embodiment, the elongated diagonal corner panel could serve to accommodate the dispensing fixture receiving and retaining structure.

Figure 3:
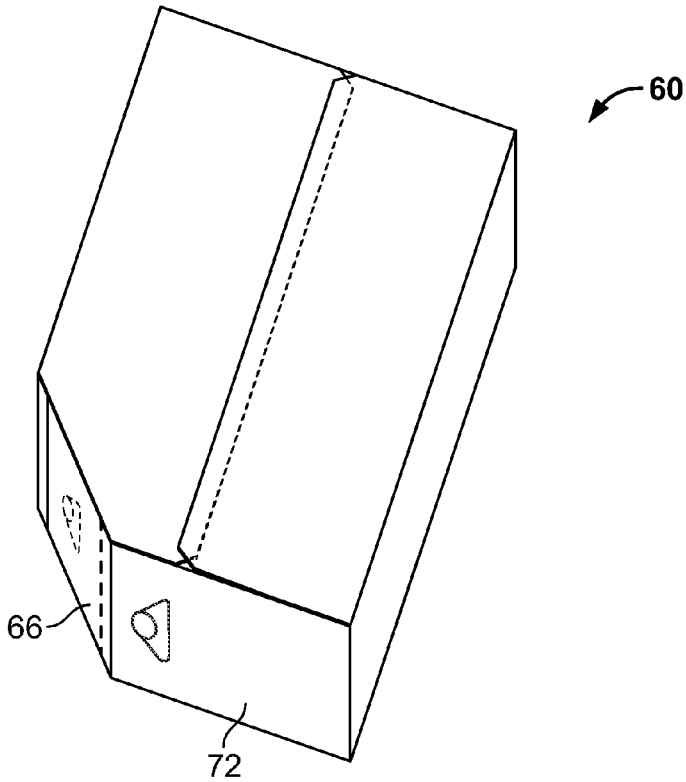
FIG. 3 is a perspective view of a bag-in-box container according to an alternative embodiment of the present invention, in which only one diagonal corner is provided.
Figure 4:
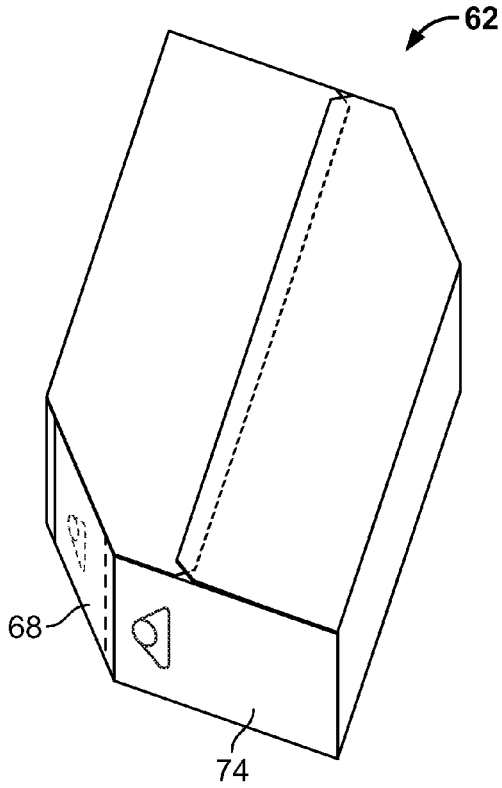
FIG. 4 is a perspective view of a bag-in-box container according to an alternative embodiment of the present invention, in which two diagonal corners are provided.
Figure 5:
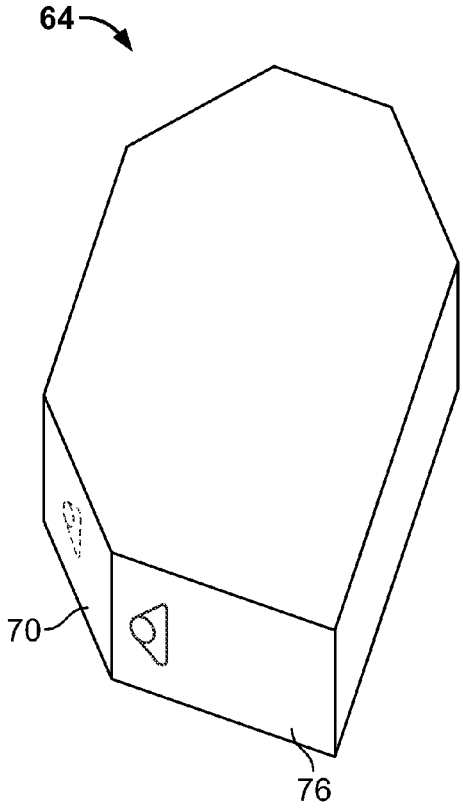
FIG. 5 is a perspective view of a bag-in-box container according to an alternative embodiment of the present invention, in which three diagonal corners are provided.

In other alternative preferred embodiments of the invention, the outer box may be provided with fewer than four diagonal corners, such as box 60 with one diagonal (FIG. 3), box 62 with two diagonals (FIG. 4) or box 64 with three diagonals (FIG. 5). In each of these embodiments, as discussed above, the dispensing fixture receiving and retaining structures may be disposed in a long diagonal corner panel (66, 68 or 70) or in a width side panel (72, 74, 76). Such alternative embodiments may be desired where maximization of use of volume is desired, as, for example, an outer box having a single diagonal corner panel will use up more of the available footprint of a pallet, than an outer box having more diagonal corner panels. A further consideration is that with more diagonal corner panels comes increased stacking strength, for the same general size outer box. In addition, increasing the number of diagonal corner panels has the added benefit of reducing outward bulging of the sides of the outer box.

The foregoing description and drawings merely explain and illustrate the invention and the invention is not limited thereto, as those skilled in the art who have the disclosure before them will be able to make modifications and variations therein without departing from the scope of the invention.

What is claimed is:

1. A bag-in-box container, for dispensing liquids, comprising:

an outer box; and an inner liquid-impermeable bag, having a dispensing fixture;

the outer box having a front face;

a rear face, disposed substantially parallel to the front face;

two pairs of opposing side panels extending between the front face and the rear face, a first of the two pairs of opposing side panels being disposed substantially perpendicular to a second of the two pairs of opposing side panels, at least one of the side panels having structure disposed therein for receiving and retaining the dispensing fixture of the liquid-impermeable bag;

a plurality of diagonal corner panels, extending between the front and rear faces, and between adjacent ones of the side panels, each of the side panels having a length which is substantially greater than the lengths of the diagonal corner panels, at least one of the diagonal corner panels, disposed adjacent to the side panel having the dispensing fixture receiving and retaining structure, having an elongated length, which is substantially greater than at least one other of the diagonal corner panels, for enabling the bag-in-box container to be tipped onto one of the at least one elongated diagonal corner panels, for facilitated dispensing of liquid contained within the inner liquid impermeable bag.

2. The bag-in-box container according to claim 1, wherein the plurality of diagonal corner panels comprises four diagonal corner panels, with each diagonal corner panel disposed between and connecting two side panels.

3. The bag-in-box container according to claim 2, wherein three of the diagonal corner panels have a first length, and a fourth of the diagonal corner panels has a second length which is substantially greater than the first lengths of the other three diagonal corner panels.

4. The bag-in-box container according to claim 1, wherein the bag-in-box container has an octagonal cross-sectional configuration.

5. The bag-in-box container according to claim 1, wherein the dispensing fixture receiving and retaining structure comprises:

a dispensing fixture retaining flap, pivotably disposed in the side panel; and a disc, formed by a circumferential frangible line of weakness, disposed adjacent to the dispensing fixture retaining flap, whereupon removal of the disc, and pivoting of the dispensing fixture retaining flap, access to the interior of the outer box is provided, for enabling withdrawal of the dispensing fixture of the inner liquid impermeable bag.

6. A box, operably configured for containing therein a liquid-impermeable bag of the type having a dispensing fixture, for facilitating dispensing of a liquid from a liquid impermeable bag when contained within the box, the box comprising:

a front face;

a rear face, disposed substantially parallel to the front face;

two pairs of opposing side panels extending between the front face and the rear face, a first of the two pairs of opposing side panels being disposed substantially perpendicular to a second of the two pairs of opposing side panels, at least one of the side panels having structure disposed therein for receiving and retaining a dispensing fixture of a liquid-impermeable bag;

a plurality of diagonal corner panels, extending between the front and rear faces, and between adjacent ones of the side panels, each of the side panels having a length which is substantially greater than the lengths of the diagonal corner panels, at least one of the diagonal corner panels, disposed adjacent to the side panel having the dispensing fixture receiving and retaining structure, having an elongated length which is substantially greater than at least one other of the diagonal corner panels, for enabling the box to be tipped onto one of the at least one elongated diagonal corner panels, for facilitated dispensing of liquid contained within a liquid impermeable bag, when disposed in the box.

7. The box according to claim 6, wherein the plurality of diagonal corner panels comprises four diagonal corner panels, with each diagonal corner panel disposed between and connecting two side panels.

8. The box according to claim 7, wherein three of the diagonal corner panels have a first length, and a fourth of the diagonal corner panels has a second length which is substantially greater than the first lengths of the other three diagonal corner panels.

9. The box according to claim 6, wherein the box has an octagonal cross-sectional configuration.

10. The box according to claim 6, wherein the dispensing fixture receiving and retaining structure comprises:

a dispensing fixture retaining flap, pivotably disposed in the side panel; and a disc, formed by a circumferential frangible line of weakness, disposed adjacent to the dispensing fixture retaining flap, whereupon removal of the disc, and pivoting of the dispensing fixture retaining flap, access to the interior of the box is provided, for enabling withdrawal of a dispensing fixture of a liquid impermeable bag, when disposed in the box.

11. A blank for forming a box, operably configured for containing therein a liquid-impermeable bag of the type having a dispensing fixture, for facilitating dispensing of a liquid from a liquid impermeable bag when contained within the box, the blank comprising:

a plurality of substantially rectangular side panels;

a plurality of substantially rectangular diagonal corner panels, disposed between adjacent ones of the substantially rectangular side panels;

the side panels and the diagonal corner panels together forming a sequence of container panels, the sequence having a longitudinal axis and beginning and terminating with side panels, the beginning and terminating side panels having opposing free edges;

a manufacturer's joint panel emanating from the respective free edges of the beginning and terminating side panels;

face panels emanating from opposing edges of alternating ones of the side panels, in directions substantially perpendicular to the longitudinal axis of the sequence of container panels;

each of the side panels having a length which is substantially greater than the lengths of the diagonal corner panels, at least one of the side panels having structure disposed therein for receiving and retaining a dispensing fixture of a liquid-impermeable bag;

the manufacturer's joint panels being configured, upon articulation of the blank, to be disposed in overlying, partially overlapping configuration, to form a composite diagonal corner panel having a length which is substantially greater than that of at least one of the other diagonal corner panels, for enabling the box to be tipped onto one of the at least one elongated diagonal corner panels, for facilitated dispensing of liquid contained within a liquid impermeable bag, when disposed in the box.

12. The blank according to claim 11, further comprising:

support panels emanating from opposing edges of remaining ones of the side panels, in directions substantially perpendicular to the longitudinal axis.

13. The blank according to claim 11, further comprising a hand-hold formed in one of the face panels.

14. The blank according to claim 11, wherein the plurality of side panels comprises four side panels.

15. The blank according to claim 11, wherein the plurality of diagonal corner panels comprises three diagonal corner panels.

16. A bag-in-box container, for dispensing liquids, comprising:

an outer box; and an inner liquid-impermeable bag, having a dispensing fixture;

the outer box having a front face;

a rear face, disposed substantially parallel to the front face;

two pairs of opposing side panels extending between the front face and the rear face, a first of the two pairs of opposing side panels being disposed substantially perpendicular to a second of the two pairs of opposing side panels, a plurality of diagonal corner panels, extending between the front and rear faces, and between adjacent ones of the side panels, each of the side panels having a length which is substantially greater than the lengths of the diagonal corner panels, at least one of the diagonal corner panels having structure disposed therein for receiving and retaining the dispensing fixture of the liquid-impermeable bag for enabling the bag-in-box container to be tipped onto one of the side panels, for facilitated dispensing of liquid contained within the inner liquid impermeable bag, from the diagonal corner panel, the at least one of the diagonal corner panels having structure disposed therein having a length greater than at least one other of the diagonal corner panels.

17. A bag-in-box container, for dispensing liquids, comprising:

an outer box; and an inner liquid-impermeable bag, having a dispensing fixture;

the outer box having a front face;

a rear face, disposed substantially parallel to the front face;

two pairs of opposing side panels extending between the front face and the rear face, a first of the two pairs of opposing side panels being disposed substantially perpendicular to a second of the two pairs of opposing side panels, at least one of the side panels having structure disposed therein for receiving and retaining the dispensing fixture of the liquid-impermeable bag;

at least two, but less than four, diagonal corner panels, extending between the front and rear faces, and between adjacent ones of the side panels, one of the at least two, but less than four, diagonal corner panels having a length greater than the other of the at least two, but less than four, diagonal corner panels:

each of the side panels having a length which is substantially greater than the length of the at least two, but less than four, diagonal corner panels, the bag-in-box container being configured to be tipped onto the at least one diagonal corner panel, for facilitated dispensing of liquid contained within the inner liquid impermeable bag.

18. A blank for forming box, operably configured for containing therein a liquid-impermeable bag of the type having a dispensing fixture, for facilitating dispensing of a liquid from a liquid impermeable bag when contained within the box, the blank comprising:

a plurality of substantially rectangular side panels;

at least two, but less than four, substantially rectangular diagonal corner panels, disposed between adjacent ones of the substantially rectangular side panels, one of the at least two, but less than four, diagonal corner panels having a length greater than the other of the at least two, but less than four, diagonal corner panels;

the side panels and the at least two diagonal corner panel together forming a sequence of container panels, the sequence having a longitudinal axis and beginning and terminating with side panels, the beginning and terminating side panels having opposing free edges;

a manufacturer's joint panel emanating from the respective free edges of the beginning and terminating side panels;

face panels emanating from opposing edges of alternating ones of the side panels, in directions substantially perpendicular to the longitudinal axis of the sequence of container panels;

each of the side panels having a length which is substantially greater than the length of the at least one diagonal corner panel, at least one of the side panels having structure disposed therein for receiving and retaining a dispensing fixture of a liquid-impermeable bag;

the blank being operably configured, upon articulation, to form a box, capable of being tipped onto the at least one diagonal corner panel, for facilitated dispensing of liquid contained within a liquid impermeable bag, when disposed in the box.

19. A box, operably configured for containing therein a liquid-impermeable bag of the type having a dispensing fixture, for facilitating dispensing of a liquid from a liquid impermeable bag when contained within the box, the box comprising:

a front face;

a rear face, disposed substantially parallel to the front face;

two pairs of opposing side panels extending between the front face and the rear face, a first of the two pairs of opposing side panels being disposed substantially perpendicular to a second of the two pairs of opposing side panels, at least one of the side panels having structure disposed therein for receiving and retaining a dispensing fixture of a liquid-impermeable bag;

at least two, but less than four, diagonal corner panels, extending between the front and rear faces, and between adjacent ones of the side panels, one of the at least two, but less than four, diagonal corner panels having a length greater than the other of the at least two, but less than four, diagonal corner panels:

each of the side panels having a length which is substantially greater than the length of the at least two, but less than four, diagonal corner panels, the box being operably configured to be tipped onto one of the at least one diagonal corner panels, for facilitated dispensing of liquid contained within a liquid impermeable bag, when disposed in the box.

* * * * *